US005420001A

United States Patent [19]

Ito et al.

[11] Patent Number: 5,420,001

[45] Date of Patent: May 30, 1995

[54] SILVER HALIDE PHOTOGRAPHIC MATERIAL FOR MEDICAL CARE AND AN IMAGE FORMING METHOD THEREFOR

[75] Inventors: Tadashi Ito; Itsuo Fujiwara; Naoki Arai, all of Kanagawa, Japan

[73] Assignee: Fuji Photo Film Co., Ltd., Kanagawa, Japan

[21] Appl. No.: 339,220

[22] Filed: Nov. 8, 1994

Related U.S. Application Data

[63] Continuation of Ser. No. 51,695, Apr. 26, 1993, abandoned.

[30] Foreign Application Priority Data

Apr. 27, 1992 [JP] Japan ..... 4-107887

[51] Int. Cl.[6] ..... G03C 1/035; G03C 1/09; G03C 1/08; G03C 5/16

[52] U.S. Cl. ..... 430/567; 430/604; 430/605; 430/608; 430/966

[58] Field of Search ..... 430/567, 568, 604, 605, 430/608, 364, 363, 966, 967

[56] References Cited

U.S. PATENT DOCUMENTS

| | | | |
|---|---|---|---|
| 5,057,402 | 10/1991 | Shiba et al. | 430/567 |
| 5,166,044 | 11/1992 | Asami | 430/567 |
| 5,204,234 | 4/1993 | Asami | 430/567 |
| 5,260,176 | 11/1993 | Otani et al. | 430/567 |
| 5,273,872 | 12/1993 | Asami | 430/567 |

*Primary Examiner*—Richard L. Schilling
*Attorney, Agent, or Firm*—Sughrue, Mion, Zinn, Macpeak & Seas

[57] ABSTRACT

There is disclosed a silver halide photographic material for a medical care which provides a good silver color tone in a laser exposures a high sensitivity and an excellent rapid processing performance. The silver halide photographic material for a medical care comprises (A) a transparent support having the thickness of 150 μm or more, and (B) a silver halide emulsion layer provided on the trasparent support, wherein silver halide grains in the silver halide emulsion layer, which contain those having a (100) face/(111) face ratio of 5 or more and those having a silver bromide-localized phase on the surface thereof, have an average grain size of not larger than 0.4 μm in terms of a projected area circle-corresponding diameter, a silver chloride content of at least 90 mole %, and an iron compound of $10^{-5}$ mole or more per mole of silver halide.

3 Claims, No Drawings

SILVER HALIDE PHOTOGRAPHIC MATERIAL FOR MEDICAL CARE AND AN IMAGE FORMING METHOD THEREFOR

This is a Continuation of application Ser. No. 08/051,695 filed Apr. 26, 1993, now abandoned.

FIELD OF THE INVENTION

The present invention relates to a silver halide photographic material for medical care, specifically to a silver halide photographic material for medical care which provides a good silver color tone upon laser exposure, a high sensitivity and an excellent rapid processing aptitude.

BACKGROUND OF THE INVENTION

The image color tone is important aspect of silver halide photographic materials, since there is an inclination for the color tone of developed silver to turn an undesirable yellowish color from the desirable bluish black or neutral black color, particularly for an observer of an image on a light table for medical care. The color tone of developed silver depends on the grain size and the grain thickness of the silver halide emulsion. The decrease in the grain thickness is accompanied with a decrease in the size and thickness of developed silver while the scattering in the blue light component is increased to result in a light having a strong yellowish color. Accordingly, as described in JP-A-60-154251 (the term "JP-A" as used herein means an unexamined Japanese patent application), 62-276539, 61-285445, 2-297539, and 3-100645, a substantially water insoluble dye is incorporated into the light-sensitive material so that the color tone of the developed silver becomes bluish black or neutral black, thus allowing adjustment of the color tone.

Further, it is known to use a mercapto compound as a color toning agent.

Meanwhile, the improvement in the covering power of a silver halide photographic material has so far been acknowledged as an important factor since it leads to the lowering of the silver/binder ratio which is necessary for rapid processing. However, an emulsion having a high covering power generally has the problem that the above silver image after a development is inclined to turn a yellowish color. This problem is notable when using a fine silver halide grains, particularly in a cubic grain having a projected area corresponding circle diameter of less than 0.4 μm. The improvement in the color tone of the silver image with this fine silver halide grain is insufficient with the above-described conventional techniques.

In recent years, a laser imager in which a laser beam is scanned to record on a photographic material has been popular in the medical care field as a recording system for an output image in diagnostic equipment such as X ray CT and MRI (a nuclear magnetic resonance). The recordation of an image and development processing in a shorter time period are desired for this laser imager system to allow rapid diagnosis.

The exposing wavelength in the laser imager is 600 to 700 nm in an He-Ne laser and an AlGaP semi-conductor laser and a near infrared range to an infrared range for a semiconductor laser. A photographic material used for recording is needed to be spectrally sensitized to 600 nm or more.

Further, these photographic materials have more extensive blackened density portions compared with other light-sensitive materials for medical care, often causing the problem (hereinafter referred to as "an emulsion pick off") that the blackened portion is stripped away by a foreign substance present on the roller while processing with a roller type automatic processor. It is known that a silver/binder (as the binder, mainly gelatin) ratio may be lowered in order to improve this emulsion pick off. In order to lower the silver/binder ratio, the grain size of silver halide may be decreased to increase a covering power, but this leads to the above mentioned deterioration of the silver color tone.

Further, an increase in the covering power with a fine grain ratio is accompanied with the deterioration of the sensitivity. Accordingly, a technique for increasing the sensitivity is necessary.

Thus, a photographic material having a good silver color tone, a high sensitivity and a high covering power, and the image forming method therefor, have been desired for a recording material for a laser imager.

SUMMARY OF THE INVENTION

The object of the present invention is to provide a silver halide photographic material which provides an excellent silver color tone and reduced emulsion pick off for medical care application and which has a high sensitivity upon laser exposure.

Another object of the present invention is to provide an image forming method by which the silver color tone on the above photographic material is improved, thus providing an image having an excellent quality at a high sensitivity.

The above objects of the present invention have been achieved by a silver halide photographic material for a medical care, comprising:

(A) a transparent support having the thickness of 150 μm or more, and (B) a silver halide emulsion layer provided on said trasparent support, wherein silver halide grains in the silver halide emulsion layer, which contain those having a (100) face/(111) face ratio of 5 or more and those having a silver bromide-localized phase on the surface thereof, have an average grain size of not larger than 0.4 μm in terms of a projected area circle-corresponding diameter, a silver chloride content of at least 90 mole %, and an iron compound of $10^{-5}$ mole or more per mole of silver halide.

Further, the above objects have been preferably achieved by an image forming method in which the above silver halide photographic material is subjected to laser exposure and then developed in a developing solution containing dihydroxybenzenes as a developing agent and having a bromide ion concentration of 0.012 mole/liter or less and/or in the presence of a benzotriazole compound.

DETAILED DESCRIPTION OF THE INVENTION

The present invention will be explained below in detail.

The high silver chloride emulsion contained in the photographic emulsion layer of the photographic material used in the present invention is silver bromochloride, silver chloroiodide, and/or silver bromochloroiodide, each containing silver chloride content of 90 mole % or more (an average value), or silver chloride. The silver iodide content is preferably 1 mole % or less. Particularly preferred is silver bromochloride containing silver chloride of 96 mole % or more (the average value), or silver chloride. The high silver chloride emulsion used in the present invention has a silver bromide-localized phase on the surface of the silver halide grains, in which the silver bromide content is relatively high compared with that of the background thereof.

In a preferred embodiment of such a localization structure, the localization phase particularly exists at the edge portion and the corner portion on the crystal surface of the grains, or on the crystal face in the form of a projection. The halogen composition in the localization phase may be 10 mole % to 95 mole %, preferably 15 mole % to 90 mole %, more preferably 20 mole % to 60 mole %, and most preferably 30 mole % to 60 mole % in terms of the silver bromide content.

The residue of silver halide in the localization phase comprises silver chloride and preferably contains a trace amount of silver iodide, provided that the amount exceeding 1 mole % based on the whole amount of silver halide is not preferred as described above.

The localization phase shares preferably 0.03 mole % to 10 mole %, more preferably 0.1 mole % to 10 mole %, of the whole amount of silver halide constituting the silver halide grains. The localization phase does not need to consist of only a single halogen composition and may consist of two or more localization phases each having a different silver bromide content, or the boundary present between the localization phase and the other phases may be of the constitution in which the halogen composition thereof is continuously changing.

The silver bromide-localized phase as described above can be formed by reacting a water soluble silver salt and a water soluble halide, including water soluble bromide, with the emulsion containing the silver chloride grains or high silver chloride grains which have already been formed, by the double jet mixing method to precipitate silver bromide thereon, by converting a part of the emulsion containing the silver chloride grains or high silver chloride grains which have already been formed to a silver bromide-rich phase with the halogen conversion method, or by adding the fine silver bromide grains, high silver bromide fine grains, or sparingly soluble silver salts, each having a smaller grain size than those of the silver chloride grains or high silver chloride grains to allow silver bromide to be crystallized on the surface of the silver chloride grains or high silver chloride grains by recrystallization. Such the preparing methods are described in, for example, European Patent Publication 0,273,430A2.

The silver bromide content in the localization phase can be analyzed with an X ray diffraction method (described in, for example, "New Experimental Chemical Course 6, Structural Analysis" edited by The Chemical Society of Japna, Maruzen) or an XPS method (described in, for example, Surface Analysis,—IMA, Application of Auger Electron/Photoelectron Spectrometry", Kohdansha). Also, the silver bromide-localized phase can be known through observation with an electron microscope or by the method described in above mentioned European Patent Publication 0,273,430A2.

Among such the methods, the forming method for the silver bromide-localized phase particularly useful in the present invention is the method in which silver bromide is formed on the surface of the high silver chloride grains while carrying out a chemical ripening. It is preferred to allow the silver bromide fine grains or silver bromochloride fine grains each having a larger solubility than that of the high silver chloride grains to be subjected to the chemical ripening to be present during the chemical ripening so as to allow the localization phase of silver bromide or silver bromochloride to be formed on the high silver chloride grains.

An iron compound should be incorporated into the high silver chloride grains according to the present invention in an amount of $10^{-5}$ mole or more, preferably between $10^{-5}$ mole and $10^{-3}$ mole, per mole of the finally formed silver halide.

The iron compound used in the present invention is a compound containing a divalent or trivalent iron ion and is preferably an iron salt and an iron complex salt each having a water solubility within the concentration range used in the present invention, e.g., Ferrous arsenate
Ferrous bromide
Ferrous carbonate
Ferrous chloride
Ferrous citrate
Ferrous fluoride
Ferrous formate
Ferrous gluconate
Ferrous hydroxide
Ferrous iodide
Ferrous lactate
Ferrous oxalate
Ferrous phosphate
Ferrous succinate
Ferrous sulfate
Ferrous thiocyanate
Ferrous nitrate
Ferrous ammonium nitrate
Basic ferric acetate
Ferric alubminate
Ferric ammonium acetate
Ferric bromide
Ferric chloride
Ferric chromate
Ferric citrate
Ferric fluoride
Ferric formate
Ferric glycerophosphate
Ferric hydroxide
Acid ferric phosphate
Ferric nitrate
Ferric phosphate
Ferric pyrophosphate
Ferric sodium pyrophosphate
Ferric thiocyanate
Ferric sulfate
Ferric ammonium sulfate
Ferric guanidine sulfate
Ferric ammonium citrate
Potassium hexacyanoferrate (II)
Potassium pentacyanoamineferrate (II)
Sodium ethylenedinitrilotetraacetic ferrate
Potassium hexacyanoferrate (III)
Ferric tris(dipyridyl) chloride
Ferric potassium pentacyanonitrosyl
Ferric hexacyano chloride Preferably used are, hexacyanoferrate (II), hexacyanoferrate (III), ferrous thiocyanate, and ferric thiocyanate.

A water soluble iridium compound can be used as the iridium compound which is preferably used in the present invention. For example, a halogenated iridium (III) compound, a halogenated iridium (IV) compound, a compound which is an iridium complex salt and which may have halogen, amines and oxalato as a ligand, a hexachloro iridium (III) or (IV) complex salt, a hexamine iridium (III) or (IV) complex salt, and a trioxalato iridium (III) or (IV) complex salt. Among these compounds, a III valent compound and a IV valent compound can arbitrarily be combined and used. These iridium compounds can be dissolved in water or a suitable solvent and used. There can be used the method generally used in order to stabilize the solution of the iridium compound, that is, the method in which a hydrogen halide aqueous solution (for example, hydrochloric acid, hydrobromic acid and hydrofluoric acid) or alkali halide (for example, KCl, NaCl, KBr and NaBr) is added. Instead of using the water soluble iridium, the other silver halide grains into which iridium is doped in advance can be added and dissolved in preparing the silver halide grains.

The total addition amount of the iridium compounds according to the present invention is $1\times10^{-8}$ mole or more, preferably $1\times10^{-8}$ to $1\times10^{-6}$ mole, and more preferably $5\times10^{-8}$ to $1\times10^{-6}$ mole, per mole of silver halide which is finally formed.

These compounds can arbitrarily be added in preparing the silver halide emulsion or at the respective steps prior to coating She emulsion. In particular, they are preferably added in forming the grains to allow them to be incorporated best into the silver halide grains.

Preferred compounds include halogen-amines and oxalato complex salts such as iridium (III) chloride, iridium (III) bromide, iridium (IV) chloride, sodium hexachloroiridate (III), a hexachloroiridium (III) salt, a hexamineiridium (IV) salt, a trioxalato-iridium (III) salt, and a trioxalatoiridium (IV) salt.

In order to allow the effects of the present invention to be demonstrated better at the various conditions, it is more preferable to incorporate metal ions other than silver, iron and iridium ions (for example, the metal ions of the VIII group, the transit metal ions of the II group, the lead ion of the IV group and the metal ions of the I group and a copper ion in the periodic table) or the complex ions thereof into the silver halide grains (the whole grains, the above-mentioned localization phaes or the other phases) used in the present invention.

Among the above metal ions or complex ions thereof, particularly useful are those selected from an iridium ion, a palladium ion, a rhodium ion, a zinc ion, an iron ion, a platinium ion, a gold ion, and a copper ion. The combined use of these metal ions or complex ions thereof rather than the single use thereof can provide the desired photographic characteristics in many cases. In particular, the kinds and amounts of the ions added to the localization phase and the other portions of the grain are preferably changed in order to effect the desired photographic characteristics. The iridium ion, iron ion and rhodium ion are particularly preferably incorporated into the localization phase.

The metal ions or complex ions thereof may be incorporated into the localization phase and/or other portions of the silver halide grain by adding these metal ions or complex ions thereof directly into a reaction vessel before or during the formation of the silver halide grains or in the physical ripening after the formation thereof. Alternatively, the metal ions or complex ions thereof may be added in advance to the aqueous solution of a water soluble halide or a water soluble silver salt. Where the localization phase is formed with a silver bromide fine grain or high silver bromide fine grain, the metal ions or complex ions thereof may be incorporated into the silver bromide fine grain or high silver bromide fine grain in the similar manner as that mentioned above and added to a silver chloride or high silver chloride emulsion.

The metal ions may be incorporated while forming the localization phase by adding relatively slightly soluble bromides of the metal ions other than silver, for example, the above metal ions in the form of a solid matter or powder. The silver halide emulsion according to the present invention preferably contains silver halide grains having a (100) face/(111) face ratio of 5 or more, preferably 10 or more in the proportion of 50 wt % or more, more preferably 60 wt % or more, and most preferably 80 wt % or more. The upper limit of the above ratio is 100% for the (100) face. A (100)/(111) face ratio less than 5 causes a deterioration of the light sensitivity with the laser of a near infrared to infrared region. In contrast, the above ratio of 5 or more is preferred from the viewpoint that a high level sensitivity in the near infrared region can be secured.

The (100) face/(111) face ratio can be measured according to the X ray diffraction analysis method described in JP-A-61-97648, the dye adsorbing method described in JP-A-63-49752, and the form observing method with an electron microscope as well as the methods described in Journal of the Chemical Society of Japan, 6, pp. 942 to 947 (1984), H. Frieser, A. Grab, D. Eschrich, Z. Elecktrochem., 65, 570 (1961) and H. Borginon, V. Banckaert, Photogr. Korr., 98, 74 (1962).

The size of the silver halide grains used in the present invention is not larger than 0.4 μm, preferably 0.35 μm or less, and more preferably 0.3 μm or less in terms of the projected area circle-corresponding diameter. The lower limit is preferably 0.1 μm.

The grains having a smaller size is preferred from the viewpoint that a silver/binder ratio can be lowered since a high covering power can be obtained with the grains having a smaller size. The size distribution of the silver halide grains may be either broad or narrow. A monodispersed emulsion is preferred in terms of the photographic properties such as a latent image stability, an anti-pressure property, and a processing stability such as a developing solution pH dependency. The value S/d, obtained by dividing the standard deviation S in the distribution of the diameter of a circle to which the projected area of a silver halide grain is converted with an average diameter d, is preferably 20% or less, more preferably 15% or less.

The silver chloride, silver bromochloride or silver bromochloroiodide emulsion used in the present invention can be prepared by the methods described in Chemie et Phisique Photographique written by P. Glafkides (published by Paul Montel Co., Ltd., 1967), Photographic Emulsion Chemistry written by G. F. Duffin (published by Focal Press Co., Ltd., 1966), and Making and Coating Photographic Emulsion written by V. L. Zelikman (published by Focal Press Co., Ltd., 1964). Methods of preparation of the emulsions include the acid method, the neutral method and the ammonia method. The acid method and neutral method are preferred in the present invention in terms of decreasing fog. A single jet method, a double jet method and a combination thereof may be used for allowing the water soluble silver salt to react with a water soluble halide to obtain a silver halide emulsion.

There also can be used a reverse mixing method in which the grains are formed under the presence of excessive silver ions. The double jet method is preferably used for obtaining the emulsion of the monodispersed grains preferred in the present invention. One preferable form of the double jet method is the method in which the silver ion concentration of the solution in which the silver halide grains are formed is maintained constant, i.e., a controlled double jet method. This method can provide a silver halide emulsion having a regular crystal form and a narrow grain size distribution, which is preferable for the present invention.

A cadmium salt, a zinc salt, a lead salt, a thallium salt, the above iridium salt or complex salts thereof, a rhodium salt or complex salt thereof, and an iron salt or complex salt thereof, may be added in the course of grain formation or physical ripening of the silver halide emulsion. A silver halide solvent may be used in or after the grain formation (for example, ammonia, thiocyanate, and thioethers and the thione compounds described in U.S. Pat. No. 3,271,157, JP-A-51-12360, 53-82408, 53-144319, 54-100717, and 54-155828), and the combined use thereof with the above method can provide the silver halide emulsion having a regular silver halide crystal form and a narrow grain size distribution, which is preferred for the present invention.

A noodle method, a flocculation settling method or a ultrafiltration method can be utilized in order to remove soluble salts from an emulsion after a physical ripening. The emulsion used in the present invention can be chemically sensitized by the single or combined use of a selenium sensitization, a reduction sensitization and noble metal sensitization. Thus, there can be used alone or in combination, a sulfur sensitization method in which there are used active gelatin and the compound including a sulfur compound capable of reacting with a silver ion (for example, thiocyanate, a thiourea compound, a mercapto compound and a rhodanine compound), a reduction sensitization method in which there is used a reductive material (for example, a stannous salt, amines, a hydrazine derivative, formamidinesulfinic acid, and a silane compound), and a noble metal sensitization method in which there is used a metal compound (for example, the above mentioned gold complex salt, and the salts of the metals of the VIII group in the periodic table, such as platinum, iridium, palladium, rhodium, and iron). In the emulsion according to the present invention, sulfur sensitization or selenium sensitization are preferably used; gold sensitization is preferably used in combination therewith. Further, in these chemical sensitizations, a hydroxyazaindene compound or nucleic acid is preferably allowed to be present in order to control the sensitivity and the gradation.

The sensitizing dyes described in JP-A-3-11336, 64-40939, 2-266934, 3-121798, 3-228741, 3-266959, and 3-311498 are preferably used as the sensitizing dye used for a laser exposure in 600nm or more according to the present invention.

These sensitizing dyes may be used either alone or in combination thereof. A combination of the sensitizing dyes is often used for the purpose of a supersensitization. A dye having no spectral sensitizing action by itself or a material which absorbs substantially no visible ray and shows a supersensitization may be incorporated into an emulsion together with the sensitizing dyes.

The combination of useful sensitizing dyes and dyes showing supersensitization and the materials showing the supersensitization are described in Research Disclosure vol. 176, No. 17643 (December 1978), pp. 23, item J in IV, above mentioned JP-B-49-25500 and 43-4933, and JP-A-59-19032 and 59-192242.

The optimum addition amount of the sensitizing dye of 600 nm or more according to the preset invention is desirably selected according to the grain size of the silver halide emulsion, the halogen composition, the method and degree of a chemical sensitization, the relationship of the layer into which the compound concerned is incorporated with the silver halide emulsion, and the kind of an anti-fogging compound, and the test method for the selection thereof is known well to the person of an ordinary skill in the art. Usually, they are used preferably in the range of $10^{-7}$ to $1\times10^{-2}$ mole, more preferably $1\times10^{-6}$ to $5\times10^{-3}$ mole per mole of silver halide.

A water soluble dye may be incorporated into a hydrophilic colloid layer of the photographic material prepared according to the present invention as a filter dye or for the various .other purposes, e.g., an anti-irradiation. The dyes are include an oxonol dye, a hemioxonol dye, a styryl dye, a merocyanine dye, a cyanine dye, and an azo dye. The oxonol dye, hemioxonol dye and merocyanine dye are preferably used.

The support for the photographic material according to the present invention has to have the thickness of 150 μm or more. The upper limit of the thickness of the support is preferably 300 μm. This is essential in terms of the handling property in observing on a light table for medical care.

The material for the support is preferably a polyethylene terephthalate film, preferably Colored blue.

The surface of the support is preferably subjected to a corona discharge treatment, a glow discharge treatment or a UV irradiation treatment. Or, there may be provided a subbing layer comprising a styrene-butadiene series latex and a vinylidene chloride series latex, and a gelatin layer may further be provided on the subbing layer.

Moreover, a subbing layer may be provided by using an organic solvent containing a polyethylene swelling agent and gelatin.

A surface treatment can be provided to these subbing layers to improve the adhering force thereof with the hydrophilic colloid layer.

The entire amount of gelatin coated on a silver halide emulsion layer side of the support according to the present invention is preferably 3.5 g/m$^2$ or less, more preferably 3.3 g/m$^2$ or less, most preferably 3.0 g/m$^2$ or less, with the lower limit being preferably 1.5 g/m$^2$.

The coated Ag amount of the silver halide emulsion per one side according to the present invention is preferably 2.6 g/m$^2$ or less, more preferably 2.3 g/m$^2$ or less, most preferably 2.0 g/m$^2$ or less, with the lower limit being preferably 1.0 g/m$^2$.

Further, the weight ratio to silver and gelatin contained in the silver halide emulsion layer is an important factor for rapid processing. An increase in the silver/gelatin ratio in the silver halide emulsions layer generates the above-described emulsion pick off where the silver halide photographic material is peeled off by projections on the roller during processing with an automatic processor, which reduces the clarity of the image. Therefore, the silver/gelatin weight ratio in the silver halide emulsion layer is preferably 1.8 or less, more preferably 1.4 or less and most preferably 1.2 or less, with the lower limit being preferably 0.3.

The various additives and methods below can be used for the light-sensitive material according to the present invention.

| Item | Corresponding portion |
|---|---|
| 1) Chemical sensitization method | Right upper column, line 13 to left upper column, line 16 at pp. 10 of JP-A-2-68539, and Japanese Patent Application No. 3-105035. |
| 2) Anti-fogging agent, & stabilizer | Left lower column, line 17 at pp. 10 to left upper column, line 7, at pp. 11 and left lower column, line 2 at pp. 3 to left lower column at pp. 4 of JP-A-2-68539. |
| 3) Color tone improving agebt | Left lower column, line 7 at pp. 2 to left lower column, line 20 at pp. 10 of JP-A-62-276539, and left lower column, line 15 at pp. 6 to right upper column, line 19 at pp. 11 of JP-A-3-94249. |
| 4) Surface active agent, & anti-electrification agent | Left upper column, line 14 at pp. 11 to left upper column, line 9 at pp. 12 of JP-A-2-68539. |
| 5) Matting agent, sliding agent, & plasticizer | Left upper column, line 10 to right upper column, line 10 at pp. 12 and left lower column, line 10 to right lower column, line 1 at pp. 14 of JP-A-2-68539. |
| 6) Hydrophilic colloid | Right upper column, line 11 to left lower column, line 16 at pp. 12 of JP-A-2-68539. |
| 7) Hardener | Left lower column, line 17 at pp. 12 to right upper column, line 6 at pp. 13 of JP-A-2-68539. |
| 8) Polyhydroxy-benzenes | Left upper column at pp. 11 to left lower column at pp. 12 of JP-A-3-39948 and EP Patent 452772A. |
| 9) Layer structure | JP-A-3-198041 |

The preferred developing solution of the present invention contains dihydroxybenzenes as a developing agent and has a bromide ion concentration of 0.012 mole/liter or less. Hydroquinone is particularly preferred as the dihydroxybenzenes. Preferred is the combined use with 3-pyrazolidones, particularly 1-phenyl-3-pyrazolidone and 1-phenyl-4-methyl-4-hydroxymethyl-3-pyrazolidones in order to obtain a high sensitivity.

The developing solution used in the present invention has a bromide ion concentration of 0.012 mole/liter or less because conventional developing solution used for medical care having a bromide ion concentration of 0.016 mole/liter or more causes increased development inhibition for a high silver chloride-containing photographic material and thus is unsuitable for rapid processing. The lower limit of the bromide concentration is preferably 0.0004 mole/liter or more, more preferably 0.001 mole/liter or more since the suitable presence of bromide ion can lower fog.

In order to lower the yellowish color in the color tone of developed silver, it is preferred to develop the photographic material according to the present invention under the presence of benzotiazoles after subjecting it to a laser exposure.

Of benzotriazoles used in the present invention, the preferred compound is represented by the following Formula (I):

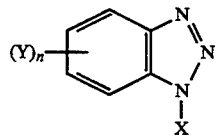

Formula (I)

wherein Y represents an alkyl group having a carbon atom number of 1 to 12 (for example, methyl, heptyl, and heptadecyl), a halogen atom (for example, a chlorine atom and a bromine atom), an alkoxy group having a carbon atom number of 1 to 12 (for example, methoxy and lauryloxy), an acyl group having a carbon atom number of 2 to 13 (for example, acetyl and benzyl), an acylamino group having a carbon atom number of 2 to 13 (for example, acetylamino, capryloylamino, benzoylamino, and benzene-sulfonylamino), a carbamoyl group having a carbon atom number of 1 to 12 and which may be substituted with an aliphatic or aromatic group (for example, methyl-carbamoyl and phenylcarbamoyl), a sulfamoyl group having a carbon atom number of 1 to 12 and which may be substituted with an aliphatic or aromatic group (for example, methylsulfamoyl and phenylsulfamoyl), or a monocyclic or dicyclic aryl group (for example, phenyl), with the proviso that Y does not represent a nitro group; n represents 0, 1 or 2; when n is 2, the two Y's may represent substituents different from each other; a carbon atom number of the alkyl group portion contained in Y is particularly preferably 1 to 3; X represents a hydrogen atom, a halogen atom (for example, a chlorine atom and a bromine atom), or an acyl group having a carbon atom number of 1 to 10 (for example, acetyl and propionyl). The concrete examples of the compound represented by Formula [I] are shown below.

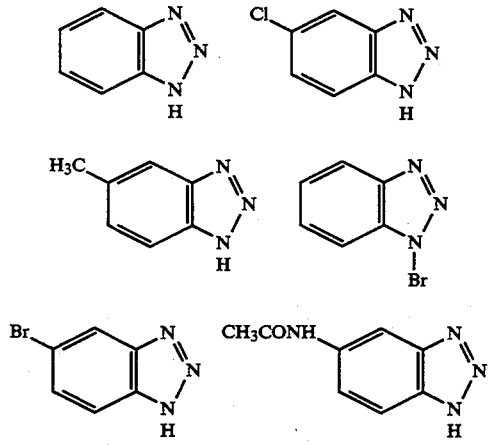

The benzotriazole compound represented by Formula [I] can be synthesized as illustrated by, for example, "Organic Synthesis", vol. 3, pp. 106, and "Journal of the Chemical Society", vol. 119, pp. 2088 to 2094 (1921); pp. 1143 to 1153 (1931); and sec. C, pp. 1474 to 1478 (1969).

In order to carry out development with the presence of benzotriazoles according to the method of the present invention, the benzotriazoles may be either contained in a light-sensitive material or added to the developing solution. Benzotriazoles can be incorporated into one or more hydrophilic colloid layers in the light-sensitive material. Benzotriazoles may be contained either in a light-sensitive emulsion layer or a non-light-sensitive emulsion layer. When it is contained in the light-sensitive layer, this emulsion layer is preferably the emulsion layer essentially used according to the method of the present invention but may be a different emulsion layer. The benzotriazole may be contained either in a single layer or two or more layers. When it is contained in the non-light-sensitive hydrophilic colloid layer, this layer may be anyone of the intermediate layer, the protective layer, the back layer, and the layer existing between an emulsion layer and a support (the underlayer). However, the benzotriazole is preferably contained in the layer adjacent to the silver halide emulsion layer essentially used in the present invention.

Benzotriazoles may be added to a developing solution.

Benzotriazoles may be added in the form of a solution in which they are dissolved in an organic solvent which is miscible with water, such as alcohols (for example, methanol and ethanol), ketones (for example, acetone and methyl ethyl ketone), and esters (for example, ethyl acetate), or water, during the preparation of the developing solution or to the finished developing solution. These solvents can be used in an acidic or base form according to necessity.

The light-sensitive material can be processed as well in a bath containing benzotriazoles prior to a development after exposure.

The amount of the benzotriazole compound in the photographic emulsion is preferably $10^{-4}$ to $10^{-1}$ mol/mol Ag, more preferably $10^{-3}$ to $3\times10^{-2}$ mol/mol Ag.

Also where benzotriazole is contained in a non-light-sensitive hydrophilic colloid layer, it is should be present in the above mentioned amount per a silver salt present on the same area.

Where benzotriazole is added to a developing solution, the addition amount thereof is preferably $10^{-6}$ to $10^{-1}$ mol/liter of the developing solution, more preferably $3\times10^{-5}$ to $3\times10^{-2}$ mol/liter of the developing solution.

Preservative of sulfites used in the present invention are available, including sodium sulfite, potassium sulfite, lithium sulfite, ammonium sulfite, sodium bisulfite, potassium metabisulfite, and sodium formaldehyde bisulfite. Sulfites are preferably added in the amount of 0.04 mole/liter or more, more preferably 0.15 mole/liter or more. The upper limit thereof is more preferably up to 1.0 mole/liter, particularly preferably up to 0.65 mole/liter.

Alkali agents used for settling pH include a pH controlling agent and a buffer agent such as sodium hydroxide, potassiumhydroxide, sodiumcarbonate, and potassium carbonate.

Additives other than those mentioned above include a development inhibitor such as a compound including boric acid and borax, sodium bromide, potassium bromide, and potassium iodide; an organic solvent such as ethylene glycol, diethylene glycol, triethylene glycol, dimethylformamide, methyl cellosolve, hexylene glycol, methanol, and ethanol; an antifogging agent such as a mercapto series compound including 1-phenyl-5-mercaptotetrazole and sodium2-mercaptobenzimidazole-5-sulfonate, and an indazole series compound including 5-nitroindazole. Further, according to necessity, a color toning agent, a surface active agent, a deforming agent, a softening agent, a hardener, and the amino compounds described in JP-A-56-106244, 61-267759, and JP-A-2-208652, may also be included as an additive.

Compounds used for the developing solution of the present invention include the compounds described in JP-A-56-24347 as an anti-silver stain agent, the compounds described in JP-A-62-212651 as an anti-uneven development agent, and the compounds described in JP-A-61-267759 as a dissolution aid.

The developing solution used in the present invention may include boric acid described in JP-A-62-186259, sugars (for example, sucrose) described in JP-A-60-93433, oximes (for example, acetoxime), and phenols (for example, 5-sulfosalicylic acid) as a buffer agent.

The processing method according to the present invention can be carried out in the presence of polyalkylene oxide. In order to incorporate polyalkylene oxide into the developing solution, polyethylene glycol having an average molecular weight of 1000 to 6000 is preferably used in the range of 0.1 to 10 g/liter.

A fixing solution may contain a water soluble aluminum compound as a hardener in addition to a fixing agent. Further, the fixing solution should be an acidic aqueous solution containing acetic acid and dibasic acid (for example, tartaric acid, citric acid, and the salts thereof) according to necessity and preferably has a pH of 3.8 or more, more preferably 4.0 to 6.5.

Sodium thiosulfate and ammonium thiosulfate may be used as the fixing agent, and ammonium thiosulfate is particularly preferred in terms of fixing speed. The amount of the fixing agent used can arbitrarily is flexible, although it is generally about 0.1 to about 5 mole/liter.

Water soluble aluminum compounds which act primarily as hardeners in the fixing solution are compounds which are generally known as the hardener for an acidic hardening fixing solution, including aluminum chloride, aluminum sulfate, potassium alum.

Tartaric acid or a derivative thereof and citric acid or a derivative thereof can be used alone or in combination with the above dibasic acid. The effective amount of those compound in the fixing solution is 0.005 mole or more per liter of the fixing agent. Particularly effective is a solution containing these compounds in the amount of 0.01 to 0.03 mole per liter of the fixing solution.

Specific examples include tartaric acid, potassium tartarate, sodium tartarate, potassium sodium tartarate, ammonium tartarate, and ammonium potassium tartarate.

Citric acid, sodium citrate, and potassium citrate are examples of citric acid or the derivative thereof which are effective in the present invention. The fixing solution further contains a preservative. (for example, sulfite and bisulfite), a pH buffer agent (for example, acetic acid and boric acid), a pH controlling agent (for example, ammonia and sulfuric acid), an image preservation improver (for example, potassium iodide), and a chelating agent according to necessity. The pH buffer agent is used in the amount of 10 to 40 g/liter, preferably 18 to 25 g/liter since pH of the developing solution is high.

A roller transporting type automatic processor is described in U.S. Pat. Nos. 3,025,779 and 3,545,971. It will bw referred to simply as "a roller transporting type processor" hereinafter in the instant specification. The roller transporting type processor consists of the four steps of developing, fixing, rinsing and drying. In the present invention, the other steps (for example, a stopping step) are not excluded but these four steps are most preferably followed.

The replenishing amount of a rinsing water may be 1200 ml/m$^2$ or less (including 0). If the replenishing amount of the rinsing water (or a stabilizing solution) is 0, the stock water rinsing method should be used. A multi-stage countercurrent system (for example, 2 stages and 3 stages) is known from the past as the method for decreasing a replenishing amount.

The following techniques can be used when the replenishing amount of the rinsing water is small in order to obtain an excellent processing performance.

The following compounds can be used in combination as microbiocides for the rinsing bath or stabilizing bath; the isothiazline series compounds described in "J. Image Tech." written by R. T. Kreiman, vol. 10, No. 6, 242 (1984), the isothiazoline series compounds described in Research Disclosure (R.D.) vol. 205, No. 20526 (May 1981), the isothiazoline series compounds described in R. D. vol. 228, No. 22845 (April 1983), and the compounds described in JP-A-61-115154 and 62-209532. In addition to the above other microbiocidal compounds that may be used include the compounds described in "Anti-fungus and Anti-mold Chemistry" written by Hiroshi Horiguchi, Sankyo Publication (1982), "Anti-fungus and Anti-mold Technique Handbook" Japan Anti-fungous and Anti-mold Association, Hakuhodo (1986), L. E. West "Water Quality Criteria" Photo Sci. & Eng. vol. 9, No. 6 (1965), M. W. Beach "Microbiological Growths in Motion Picture Processing" SMPTE Journal vol. 85 (1976), and R. 0. Deegan "Photo Processing Wash Water Biocides" J. Imaging Tech. vol. 10, No. 6 (1984).

A squeeze roller and a crossover rack washing bath described in JP-A-63-18350 and 62-287252 are preferably used when rinsing is carried out with the small amount of rinsing water in the method of the present invention. Further, a part or all of the overflow solution from the rinsing or stabilizing bath, which is generated by the replenishing water provided with the anti-mold composition added to the rinsing or stabilizing bath of the present invention, can also be utilized for a processing solution having a fixing function, which is the preceding bath thereof, as described in JP-A-60-235133 and 63-129343. Further, in order to avoid water spots which are liable to generate when"-rinsing with a small amount of a rinsing water and/or to prevent processing agent components stuck on the squeeze roller from being transferred to the processed film, a water soluble surface active agent and a deforming agent may be added.

A dye-adsorbing agent described in JP-A-63-163456 may be provided in the rinsing bath for the purpose of preventing a stain by a dye eluted from a light-sensitive material.

The light-sensitive material according to the present invention provides excellent performance in rapid development processing with an automatic processor in which the total processing time is 15 to 60 seconds. In this rapid development processing, the temperature and time in developing and fixing are approximately 25° to 50° C. and 25 seconds or less, preferably 30° to 40° C. and 4 to 15 seconds, respectively.

In the present invention, the light-sensitive material is subjected to a rinsing or stabilizing treatment after being subjected to developing and fixing, wherein a 2 to 3 stage countercurrent rinsing system can be used at the rinsing step to allow the savings of a water. When rinsing is carried out with a small amount of rinsing water, a squeeze roller rinsing bath is preferably provided. Further, as stated above, a part or all of the overflowing solution from the rinsing bath or stabilizing bath can be utilized for the fixing solution as described in JP-A-60-235133.

In the present invention, the light-sensitive material which is subjected to developing, fixing and rinsing is dried after passing through a squeeze roller. The drying is carried out at 40° to 80° C. for 4 to 30 seconds.

The total processing time for the present invention is the total time from when the edge of a film is inserted into the inlet of an automatic processor to when it comes out from the drying outlet after passing through a developing bath, a passage part, a fixing bath, a passage part, a rinsing bath, a passage part, and a drying part.

In the silver halide light-sensitive material according to the present invention, the amount of gelatin used as a binder for the emulsion layer and the protective layer can be reduced without detrimentally affecting the pressure fog. Therefore, in the rapid processing in which the total processing time is 15 to 60 seconds, the development processing step can be carried out without detrimentally affecting the developing speed, the fixing speed and the drying speed.

The present invention will be explained below with reference to the examples but is not limited thereby.

EXAMPLES

Example 1

1. Preparation of the Silver Emulsions a) Preparation of Emulsion A

Gelatin (32 g) was added to distilled water (900 ml), dissolved at 40° C., and then the pH was adjusted to 3.8 with sulfuric acid, followed by adding sodium chloride (3.3 g) and N,N-dimethylimidazolidine-2-thione (a 1% aqueous solution) (3.2 ml). A solution containing dissolved silver nitrate (32 g) in distilled water (200 ml) and a solution containing dissolved sodium chloride (11 g) and $K_2IrCl_6$ in the amount of $4.4\times10^{-5}$ mole per mole of finished silver halide in distilled water 200 ml at a temperature of 40° C. over a period of 2 minutes were added and mixed with the above solution. Further, a solution containing dissolved silver nitrate (64 g) in distilled water (280 ml) and a solution containing dissolved sodium chloride (21.6 g) in distilled water (275 ml) were added and mixed at a temperature of 40° C. over a period of 5 minutes. Subsequently, there were added a solution containing dissolved silver nitrate (64 g) in distilled water (280 ml) and a solution containing dissolved sodium chloride (22.4 g) and $K_4Fe(CN)_6$ 3 $H_2O$ in the amount of $1\times10^{-4}$ mole per mole of silver halide in distilled water (285 ml) at a temperature of 40° C. over a period of another 5 minutes.

The emulsion thus obtained was observed with an electron microscope to find that the emulsion contained cubic grains having a projected area circle-corresponding diameter of about 0.27 μm and a fluctuation coefficient of 10% in a grain size distribution.

After this emulsion was desalted, gelatin (72 g) and phenoxyethanol (2.6 g) were added thereto. Then, the pH was adjusted to 6.7 and pAg was adjusted to 7.9 with sodium chloride. Chemical sensitization was carried out at 58° C. in the following order. First, a monodispersed silver bromide emulsion with an average grain size of 0.05 μm was added in a proportion corresponding to 1.1 mole % in relation of the amount of silver halide and then compound (1) (7.2 mg), chlorauric acid (9.2 mg), triethyl thiourea (1.3 mg), selenium sensitizer (A) (0.72 mg), and nucleic acid (0.29 g) were added. Finally, 4-hydroxy-6-methy-1,3,3a,7-tetrazaindene (162 mg) was added and the emulsion was rapidly cooled to solidify, resulting emulsion A.

Compound (1)

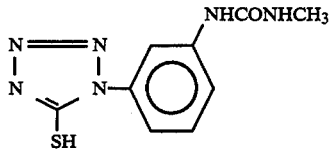

Selenium sensitizer (A)

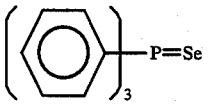

b) Preparation of emulsions B to D

Emulsions were prepared in the same manner as the emulsion A except that sodium chloride was replaced with a combination of sodium chloride and potassium bromide and that the amounts thereof were suitably adjusted and the grain formation temperature was changed, thus providing the emulsions having the halogen compositions and grain sizes shown in Table 1. The same procedure as that in emulsion A was applied after desalting, thus providing emulsions B to D. c) Preparation of the emulsions E to J Gelatin (32 g) was dissolved in distilled water (1 liter) and potassium bromide (0.3 g), sodium chloride (5 g), and N,N-dimethylimidazolidine-2-thione (a 1% aqueous solution) (4.6 ml) were put in the vessel heated to 45° C. Then, an aqueous solution (444 ml) containing silver nitrate (80 g) and an aqueous solution (452 ml) containing potassium bromide (45 g), sodium chloride (5.5 g) and $K_2IrCl_6$ in the amount of $4.4\times10^{-8}$ mole per mole of finished silver halide were added by the double jet method over a period of 20 minutes to thereby form a core portion with the silver chloride content of 20 mole %. Subsequently, an aqueous solution (400 ml) containing silver nitrate (80 g) and an aqueous solution (415 ml) containing potassium bromide (44.8 g), sodium chloride (5.5 g) and $K_4Fe(CN)_6$ 3 $H_2O$ in the amount of $1\times10^{-4}$ mole per mole of finished silver halide were added by the double jet method over a period of about 25 minutes to thereby complete the shell portion with a silver chloride content of 20 mole %, this preparation provided cubic mono-dispersed silver bromochloride grains (the fluctuation coefficient of 10% in a projected area circle-corresponding diameter diameter) having an average grain size (the projected area circle-corresponding diameter) of 0.27 μm.

After this emulsion was desalted, gelatin (72 g) and phenoxyethanol (2.6 g) were added thereto and the pH and pAg were adjusted to 6.5 and 8.5, respectively. Then, the temperature was raised to 65° C. and sodium thiosulfate (2 mg) was added. Two minutes later chlorauric acid (5 mg) was added and after 80 minutes later 4-hydroxy-6-methy-1,3,3a,7-tetrazaindene (512 mg) was added Then, the emulsion was rapidly cooled to solidify, thus providing emulsion E. Emulsions E to J were prepared in the same manner so that the average silver chloride content and average grain size were as shown in Table 1.

2. Preparation of the Emulsion Layer Coating Solutions

The following compounds were added in amounts per mole of silver halide, to the emulsions A to J to prepare the emulsion layer coating solutions.

| Composition of the emulsion layer coating solution: | |
|---|---|
| Spectral sensitizing dye (2) | $5.5\times10^{-5}$ mole |
| Supersensitizer (3) | $3.3\times10^{-4}$ mole |
| Polyacrylamide (molecular weight: 4000) | 9.2 g |
| Trimethylolpropane | 1.4 g |
| Poly(ethyl acrylate/metacrylic acid) latex | 22 g |

Spectral sensitizing dye (2)

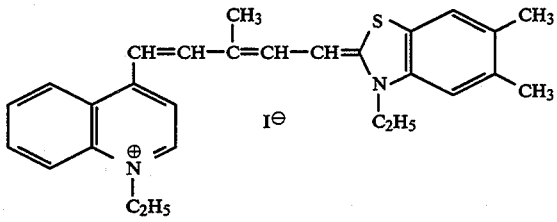

Supersensitizer (3)

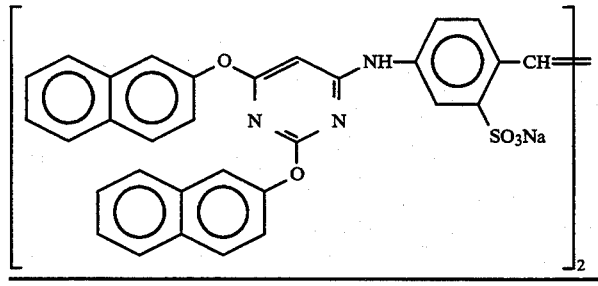

3. Preparation of the Surface Protective Layer Coating Solution for the Emulsion Layer A vessel was heated to 40° C. and the following compounds were added to prepare the coating solution.

| | |
|---|---|
| Gelatin | 100 g |
| Polyacrylamide (molecular weight: 40,000) | 12.3 g |
| Poly(sodium styrenesulfonate) (molecular weight: 600,000) | 0.6 g |
| Polymethyl metacrylate fine grains (average grain size: 2.5 μm) | 2.7 g |
| Poly(sodium acrylate) | 3.7 g |
| Sodium t-octylphenoxyethoxyethanesulfonate | 1.5 g |
| $C_{16}H_{33}O—(CH_2CH_2O)_{10}—H$ | 3.3 g |
| $C_8F_{17}SO_3K$ | 84 mg |
| $C_8F_{17}SO_2N(C_3H_7)(CH_2CH_2O)_4(CH_2)_4—SO_3Na$ | 84 mg |
| NaOH | 0.2 g |
| Methanol | 78 ml |
| 1,2-Bis(vinylsulfonylacetamide) ethane | * |
| Compound (4) | 52 mg |

-continued

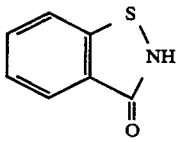

*controlled so that the amount thereof became 2.5% by weight based on the whole amount of gelatin contained in the emulsion layer and surface protective layer.

4. Preparation of the Back Layer Coating Solution

A vessel was heated to 40° C. and the following compounds were added to prepare the back layer coating solution.

| | |
|---|---|
| Gelatin | 100 g |
| Dye (A) | 2.38 g |

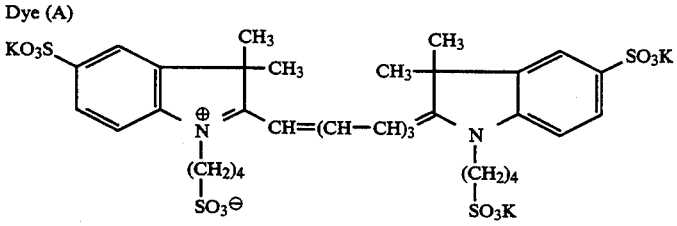

| | |
|---|---|
| Poly(sodium styrenesulfonate) | 1.1 g |
| Phosphoric acid | 0.55 g |
| Poly(ethyl acrylate/metacrylic acid) latex | 2.9 g |
| Compound (4) | 46 mg |
| Oil dispersion of the dye (B) described in JP-A-61-285445 | 246 mg (as the dye itself) |

Dye (B)

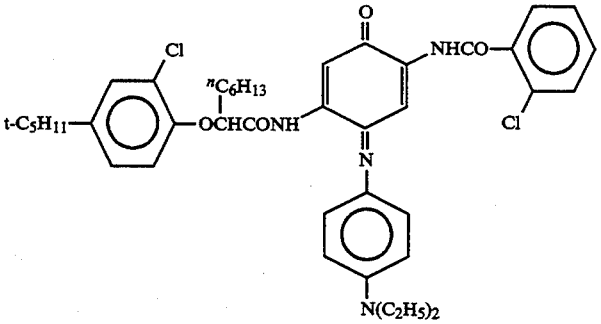

| | |
|---|---|
| Oligomer surface active agent dispersion of the dye (C) described in JP-A-62-275639 | 46 mg (as the dye itself) |

Dye (C)

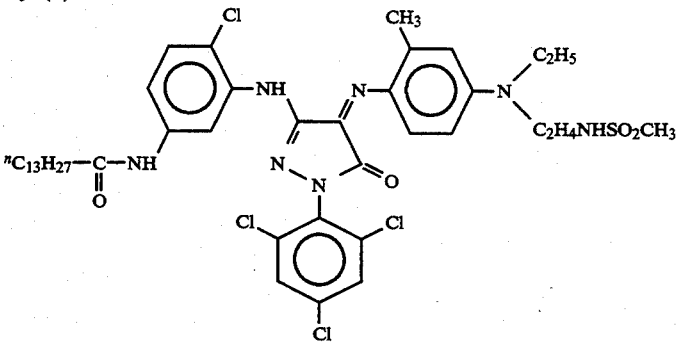

5. Preparation of the Surface Protective Layer Coating Solution for the Back Layer A vessel was heated to 40° C. and the following compounds were added to prepare the coating solution.

| | |
|---|---|
| Gelatin | 100 g |
| Poly(sodium styrenesulfonate) | 0.3 g |
| Polymethyl metacrylate fine grains (average grain size: 3.5 μm) | 4.3 g |
| Sodium t-octylphenoxyethoxyethanesulfonate | 1.8 g |
| Poly(sodium acrylate) | 1.7 g |
| $C_{16}H_{33}O—(CH_2CH_2O)_{10}—H$ | 3.6 g |
| $C_8F_{17}SO_3K$ | 268 mg |
| $C_8F_{17}SO_2N(C_3H_7)(CH_2CH_2O)_4(CH_2)_4—SO_3Na$ | 45 mg |
| NaOH | 0.3 g |
| Methanol | 131 ml |
| 1,2-Bis(vinylsulfonylacetamide) ethane | * |
| Compound (4) | 45 mg |

*controlled so that the amount thereof became 2.2% by weight based on the whole amount of gelatin contained in the emulsion layer and surface protective layer.

6. Preparation of the Photographic Material

The above mentioned back layer coating solution was coated on one side of a blue colored polyethylene terephthalate support .together with the surface protective layer coating solution for the back layer so that the gelatin coating amounts of the back layer and surface protective layer for the back layer became 2.69 g/m$^2$ and 1.13 g/m$^2$, respectively.

Subsequently, the above mentioned emulsion layer coating solution and surface protective layer coating solution were coated on the other side of the support so that the coated Ag amount became 1.85 g/m$^2$ and the gelatin coating amounts of the emulsion layer and surface protective layer became 1.6 g/m$^2$ and 1.23 g/m$^2$, respectively.

7. Preparation of the Developing Solution

| | |
|---|---|
| Potassium hydroxide | 23 g |
| Sodium sulfite | 35 g |
| Potassium sulfite | 44 g |
| Diethylenetriaminepentaacetic acid | 2 g |
| Boric acid | 10 g |
| Potassium carbonate | 13 g |
| Hydroquinone | 35 g |
| Diethylene glycol | 50 g |
| 4-Hydroxymethyl-4-methyl-1-phenyl-3-pyrazolidone | 4 g |
| 5-Methylbenzotriazole | 0.06 g |
| 2,3,5,6,7,8-Hexahydro-2-thioxo-4(1H)-quinazolinone | 0.1 g |
| Sodium 2-mercaptobenzimidazole-5-sulfonate | 0.14 g |
| Potassium bromide | 1 g (0.0084 mol) |
| Water was added to (pH was adjusted to 10.55) | 1000 ml |

8. Preparation of the Fixing Solution

| | |
|---|---|
| Ammonium thiosulfate | 140 g |
| Sodium sulfite | 15 g |
| Disodium ethyelenediaminetetraacetate dehydrate | 25 mg |
| Sodium hydroxide | 6 g |
| Water was added to (pH was adjusted to 5.10) | 1000 ml |

9. Evaluation of the Photographic Materials

The photographic materials 1 to 10 were left standing for days after coating while maintaining the temperature and humidity at 25° C. and 65% RH, respectively. The photographic materials were then subjected to a scanning exposure with a semi-conductor laser of 780 nm for $10^{-7}$ second. After the exposure, the photographic materials were processed for 30 seconds including fixing, rinsing and drying with the automatic processor FPM-2000 manufactured by Fuji Photo Film Co., Ltd., in which a driving motor and a gear were remodeled to accelerate the transporting speed, in the above mentioned developing solution and fixing solution at the developing temperature of 35° C.

The transmission color tone of developed silver was observed and evaluated at the portion at which the transmission black density of the image thus obtained was 1.0. The results obtained are shown in Table I.

TABLE I

| Photographic material | Emulsion | Grain size | Halogen composition | Color tone of developed silver |
|---|---|---|---|---|
| 1 (Inv.) | A | 0.27 μm | Cl: 98.9 mol % Br: 1.1 mol % | Blue to neutral black |
| 2 (Inv.) | B | 0.27 μm | Cl: 91.9 mol % Br: 8.1 mol % | Neutral black |
| 3 (Comp.) | C | 0.27 μm | Cl: 85.9 mol % Br: 14.1 mol % | Slightly yellowish black |
| 4 (Comp.) | D | 0.27 μm | Cl: 78.9 mol % Br: 21.1 mol % | Slightly yellowish black |
| 5 (Comp.) | E | 0.27 μm | Cl: 20 mol % Br: 80 mol % | Yellowish black |
| 6 (Comp.) | F | 0.27 μm | Cl: 40 mol % Br: 60 mol % | Yellowish black |
| 7 (Comp.) | G | 0.27 μm | Cl: 60 mol % Br: 40 mol % | Yellowish black |
| 8 (Comp.) | H | 0.34 μm | Cl: 20 mol % Br: 80 mol % | Slightly yellowish black |
| 9 (Comp.) | I | 0.34 μm | Cl: 60 mol % Br: 40 mol % | Yellowish black |
| 10 (Comp.) | J | 0.41 μm | Cl: 60 mol % Br: 40 mol % | Slightly yellowish black |

*Projected area circle-corresponding diameter.

The results summarized in Table I, illustrate that the use of the high silver chloride emulsion according to the present invention allows the silver color tone of developed silver to become a blue color to a neutral black color without giving an unpleasant yellowish color. The above described results clearly indicates that the present invention is effective.

Example 2

1. Preparation of Emulsions K to U

Gelatin (32 g) was added to distilled water 900 ml and dissolved at 40° C., and then the pH was adjusted to 3.8 with sulfuric acid, followed by adding sodium chloride (3.3 g). A solution contains dissolved silver nitrate (32 g) in distilled water (200 ml) and a solution containing dissolved sodium chloride (11 g) and $K_2IrCl_6$, in the amount shown in Table II, in distilled water (200 ml) at a temperature of 40° C. over a period of 2 minutes were added and mixed with the above solution. Further, a solution containing dissolved silver nitrate (64 g) in distilled water (280 ml) and a solution containing dissolved sodium chloride (21.6 g) in distilled water (275 ml) were added and mixed at a temperature of 40° C. over a period of 5 minutes. Subsequently, a solution containing dissolved silver nitrate (64 g) in distilled water (280 ml) and a solution containing dissolving sodium chloride (22.4 g) and $K_4Fe(CN)_6.3\ H_2O$, in the amount shown in Table II, in distilled water (285 ml) at a temperature of 40° C. over a period of another 5 minutes were added into the above solution.

The emulsion thus obtained was observed with an electron microscope to find that the emulsion contained cubic grains having a projected area circle-corresponding diameter of about 0.21 μm and a fluctuation coefficient of 9.8% in grain size distribution.

After this emulsion was desalted, gelatin (72 g) and phenoxyethanol (2.6 g) were added thereto. Then, the pH was adjusted to 6.7 and the pAg was adjusted to 7.9 with sodium chloride. Chemical sensitization was carried out at 58° C. in the following order. First, a monodispersed silver bromide fine grain emulsion with an average grain size of 0.05 μm was added in the amount shown in Table II and then compound (1) (7.2 mg) used in Example 1, chlorauric acid (9.2 mg), triethyl thiourea (1.3 mg), the selenium sensitizer (A) (0.72 mg) used in Example 1, and further nucleic acid (0.29 g) were added. Finally, 4-hydroxy-6-methy-1,3,3a,7-tetrazaindene (162 mg) was added and the emulsion was rapidly cooled to solidify, thus providing emulsions K to U.

2. Preparation of the Photographic Materials

An emulsion layer coating solution, a surface protective layer coating solution for the emulsion layer, a back layer coating solution, and a surface protective layer coating solution for the back layer were prepared in the same manner as that in Example 1.

The back layer coating solution was coated on one side of a blue colored polyethylene terephthalate support together with the surface protective layer coating solution for the back layer so that the gelatin coating amounts of the back layer and surface protective layer for the back layer became 2.69 g/m$^2$ and 1.13 g/m$^2$, respectively. Subsequently, the above mentioned respective emulsion layer coating solutions and surface protective layer coating solution were coated on the other side of the support so that the coated Ag amount and gelatin coating amount on the emulsion layer became 1.85 g/m$^2$ and 1.6 g/m$^2$, respectively and the gelatin coating amount of the surface protective layer became 1.23 g/m$^2$, thus providing photographic materials 11 to 21.

3. Method for a Sensitometry

Photographic materials 11 to 21 thus prepared were subjected to sensitometry in the following manner to measure a photographic sensitivity.

The photographic materials 11 to 21 were left standing for 7 days after coating while maintaining at a temperature and humidity of 25° C. and 60% RH. The photographic materials were subjected to a scanning exposure with a semi-conductor laser of 780 nm for $10^{-7}$ second at a room temperature. Subsequently, the photographic materials were subjected to development processing in the same manner as that in Example 1. The sensitivity is represented by the reciprocal of the exposure giving the density of 1.0 and expressed by the value relative to that of the photographic material 11, which was set at 100. The results are shown in Table II.

TABLE II

| Photographic material | Emulsion | Added amount of $K_2OrCl_6$* | Added amount of $K_4Fe(CN)_6.3\ H_2O$* | Added amount of emulsion** | Relative sensitivity |
|---|---|---|---|---|---|
| 11 (Comp.) | K | $4.4 \times 10^{-8}$ mol | 0 | 1.1 mol % | 100 |
| 12 (Inv.) | L | $4.4 \times 10^{-8}$ mol | $1 \times 10^{-5}$ mol | 1.1 mol % | 126 |
| 13 (Inv.) | M | $4.4 \times 10^{-8}$ mol | $5 \times 10^{-5}$ mol | 1.1 mol % | 219 |
| 14 (Inv.) | N | $4.4 \times 10^{-8}$ mol | $1 \times 10^{-4}$ mol | 1.1 mol % | 282 |
| 15 (Inv.) | O | $4.4 \times 10^{-8}$ mol | $2 \times 10^{-4}$ mol | 1.1 mol % | 145 |
| 16 (Comp.) | P | $4.4 \times 10^{-8}$ mol | $1 \times 10^{-4}$ mol | 0 | 100 |
| 17 (Inv.) | Q | 0 | $1 \times 10^{-4}$ mol | 1.1 mol % | 148 |
| 18 (Comp.) | R | 0 | 0 | 1.1 mol % | 100 |
| 19 (Comp.) | S | $4.4 \times 10^{-6}$ mol | 0 | 1.1 mol % | 105 |
| 20 (Inv.) | T | $4.4 \times 10^{-8}$ mol | $1 \times 10^{-4}$ mol | 2.2 mol % | 269 |
| 21 (Inv.) | U | $1.8 \times 10^{-7}$ mol | $1 \times 10^{-4}$ mol | 1.1 mol % | 224 |

*per mole of finished silver halide.
**a monodispersed silver bromide emulsion per mole of finished silver halide, which was added in a chemical sensitization.

The results summarized in Table II illustrate that the photographic materials of the present invention in which the iron compound is used and the monodispersed silver bromide fine grain emulsion was added during chemical sensitization provide high sensitivity. Further, it is illustrated that the use of Ir compound can give a higher sensitivity.

The detailed observation of the emulsions according to the present invention reveals that a silver bromide-localized phase was formed at the corner of the cube. The above results clearly show that the present invention is effective.

Example 3

The photographic materials 22 to 27 were prepared in the same manner as that in Example 1 except that the temperatures in forming the grains and the amount of N,N-dimethylimidazolidine-2-thione were changed as shown in Table III and that the amount of gelatin added after the emulsion was subjected to the desalting processing was changed so that the amount of gelatin in the emulsion layer became 1.6 g/m$^2$ when the coated Ag amount was as shown in Table III.

The photographic materials 22 to 27 were subjected to an exposure with the laser exposing equipment used in Example 1 so that the maximum density was obtained and then to the development processing in the same manner as that in Example 1. The maximum density values thus obtained are shown in Table III .

Further, 16×30 cm$^2$ photographic material was subjected to development processing with the automatic processor FPM 2000 (manufactured by Fuji Photo Film Co., Ltd.) used in Example 1, in which a squeeze roller after rinsing was abraded so as to generate emulsion pick off. The number of emulsion pick off was visually counted with a sharkasten (light table) in a dark room.

The evaluation of the emulsion pick off was based on the following criteria:

A: Not much more than several spots.
B: Not much more than ten and several spots.
C: Not much more than 20 to 50 spots.
D: 50 or more spots.

An allowable level in a practical use is A or B.

The results obtained are shown in Table III.

TABLE III

| Photographic material | Temperature* | Amount of DMIT** | Grain size | Coated Ag amount | Ag/gelatin ratio*** | Maximum density | Evaluation of pick off |
|---|---|---|---|---|---|---|---|
| 22 (Inv.) | 40° C. | 0 mg | 0.21 μm | 1.85 g/m$^2$ | 1.16 | 3.4 | A |

TABLE III-continued

| Photographic material | Temperature* | Amount of DMIT** | Grain size | Coated Ag amount | Ag/gelatin ratio*** | Maximum density | Evaluation of pick off |
|---|---|---|---|---|---|---|---|
| 23 (Inv.) | 40° C. | 0 mg | 0.21 μm | 1.6 g/m$^2$ | 1.0 | 3.0 | A |
| 24 (Inv.) | 40° C. | 32 mg | 0.27 μm | 2.3 g/m$^2$ | 1.44 | 3.4 | B |
| 25 (Inv.) | 46° C. | 32 mg | 0.37 μm | 2.9 g/m$^2$ | 1.81 | 3.0 | B to C |
| 26 (Comp.) | 48° C. | 32 mg | 0.42 μm | 3.8 g/m$^2$ | 2.4 | 3.0 | D |
| 27 (Comp.) | 48° C. | 32 mg | 0.42 μm | 3.2 g/m$^2$ | 2.0 | 2.5 | C to D |

*in the grain formation.
**DMIT: N,N-dimethylimidazolidine-2-thione.
***in the emulsion layer.

The results summarized in Table III illustrate that grain size (projected area circle-corresponding diameter) larger than 0.4 μm lowers the maximum density values and that the emulsion pick off also increases to an impractical level. Accordingly, the effectiveness of the present invention is apparent.

Example 4

The photographic material 14 in Example 2 was used and exposed in the same manner as that in Example 1. The exposed material was processed and evaluated in the same manner as that in Example 1 except that 5-methyl-benzotriazole contained in the developing solution was changed as shown in Table IV. The results obtained are shown in Table IV.

TABLE IV

| | Amount of 5-methyl-benzotriazole (g/l) | Color tone of developed Ag |
|---|---|---|
| Developing solution 1 (Comparison) | 0 | Slightly yellowish black |
| Developing solution 2 (Invention) | 0.03 | Neutral black |
| Developing solution 3 (Invention) | 0.06 | Bluish to neutral black |
| Developing solution 4 (Invention) | 0.12 | Bluish black |

It can be found from the results summarized in Table IV that the presence of benzotriazoles in the development turns the color tone of developed silver further to a preferred silver color tone of a blue color to a neutral black color.

Example 5

The photographic material 14 in Example 2 was used and exposed in the same manner as that in Example 2. The exposed material was processed and evaluated in the same manner as that in Example 2 except that the amount of potassium bromide contained in the developing solution was changed as shown in Table V and that the processing speed was set at two kinds of 25 and 30 seconds.

TABLE V

| | Amount of potassium bromide (mol/l) | Relative Sensitivity | |
|---|---|---|---|
| | | Dry to Dry 25" processing | Dry to Dry 30" processing |
| Developing solution 5 (Invention) | 0.0042 | 100 | 110 |
| Developing solution 6 (Invention) | 0.0118 | 89 | 102 |
| Developing solution 7 (Comparison) | 0.0168 | 74 | 95 |
| Developing solution 8 (Comparison) | 0.0311 | 56 | 89 |

The resulting photographic sensitivity shown in Table V is a relative sensitivity taking the value obtained in the case where the photographic material was processed with Developer 5 in a Dry to Dry time of 25 seconds of 100.

The results summarized in Table V illustrate that the increased amount of potassium bromide lowers the sensitivity and deteriorates the development acceleration.

Example 6

1. Preparation of the Emulsion Layer Coating Solutions

The following compounds were added per mole of silver halide to emulsions K to U used in Example 2 to prepare the emulsion layer coating solutions.

| | |
|---|---|
| Spectral sensitizing dye (5) | 138 mg |
| Spectral sensitizing dye (6) | 42.5 mg |
| Polyacrylamide (molecular weight: 40,000) | 8.54 g |
| Trimethylolpropane | 1.2 g |
| Poly(sodium styrenesulfonate) (molecular weight: 600,000) | 0.46 g |
| Poly(ethyl acrylate/metacrylic acid) latex | 32.8 g |
| 1,2-Bis(vinylsulfonylacetamide) ethane | 2 g |

Spectral sensitizing dye (5)

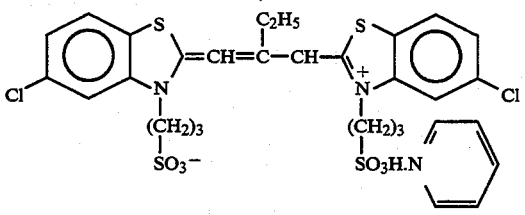

Spectral sensitizing dye (6)

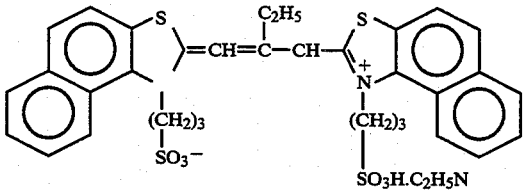

2. Preparation of the Back Layer Coating Solution A vessel was heated to 40° C. and the following compounds were added to prepare the back layer coating solution.

| | |
|---|---|
| Gelatin | 100 g |
| Dye (D) | 2.39 g |

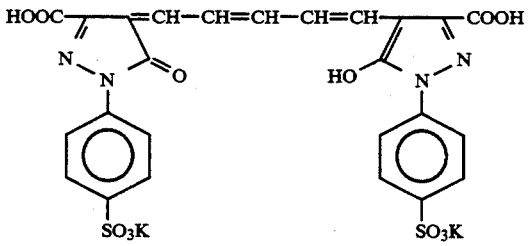

| | |
|---|---|
| Poly(sodium styrenesulfonate) | 1.1 g |
| Phosphoric acid | 0.55 g |
| Poly(ethyl acrylate/metacrylic acid) latex | 2.9 g |
| Compound (4) used in Example 1 | 46 mg |
| Oil dispersion of the dye (B) used in Example 1 described in JP-A-61-285445 | 246 mg (as the dye itself) |
| Oligomer surface active agent dispersion of the dye (C) used in Example 1 described in JP-A-62-275639 | 46 mg (as the dye itself) |

3. Preparation of the Photographic Material

The photographic material was prepared in the same manner as that in Example 2 except that the emulsion layer coating solution and back layer coating solution were replaced with the above-described ones.

4. Method for a Sensitometry

The photographic materials were subjected to a sensitometry in the following manner to measure a photographic sensitivity.

The photographic materials were left for standing for 7 days after coating while maintaining the temperature and humidity of 25° C. and 65% RH. The photographic materials were then subjected to an exposure with the He-Ne laser exposing equipment AC-1 of 633 nm manufactured by Fuji Photo Film Co., Ltd.

The development processing was carried out in the following manner. Automatic processor: SRX 501 manufactured by Konica Corp., in which a driving motor and a gear were remodeled to accelerate the transporting speed.

| Condensate of the developing solution | |
|---|---|
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-1-phenyl-3-pyrazolidone | 22.0 g |
| 5-Methylbenzotriazole | 0.2 g |
| | 0.6 g |

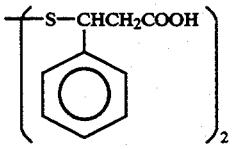

-continued

| | |
|---|---|
| Water was added to (pH was adjusted to 10.60) | 1000 ml |
| Condensate of the fixing solution | |
| Ammonium thiosulfate | 560 g |
| Sodium sulfite | 60 g |
| Disodium ethyelenediaminetetraacetate dihydrate | 0.10 g |
| Sodium hydroxide | 24 g |
| Water was added to (pH was adjusted with acetic acid to 5.10) | 1000 ml |

Before starting the development processing, the respective tanks of the automatic processor were filled with the following processing solutions:

Developing tank: the above condensate of the developing solution (333 ml), and the starter (10 ml) containing water (667 ml), potassium bromide (1 g) and acetic acid (1.8 g) were added and pH was adjusted to 10.25.

Fixing tank: the above condensate of the fixing solution (200 ml) and water (800 ml).

Processing speed: Dry to Dry 35 seconds.

Development temperature: 35° C.

Fixing temperature: 32° C.

Drying temperature: 55° C.

Replenishing amount: developing solution 11 ml/10×12 inch fixing solution 20 ml/10×12 inch The same results as those in Example 2 were obtained. Thus, the present invention was effective even when the sensitizing dyes were changed and the exposure was carried out at 633 nm.

While the invention has been described in detailed with reference to specific embodiments, it will be apparent to one skilled in the art that various changes and modifications can be made to the invention without departing from its spirit and scope.

What is claimed is:

1. A silver halide photographic material for medical care, comprising:

(A) a transparent support having a thickness of 150 μm or more, and (B) a silver halide emulsion provided on said transparent support comprising silver halide grains having a (100) face/(111) face ratio of 5 or more, a silver bromide-localized phase on the surface thereof, an average grain size of 0.35 μm or less in terms of a projected area circle-corresponding diameter, a silver chloride content of at least 90 mol %, and an iron compound of $10^{-5}$ mol or more per mol of silver halidek wherein a coated silver amount of the silver halide emulsion layer is 2.6 g/m$^2$ or less and the silver halide emulsion layer has a silver/gelatin weight ratio of 1.8 or less.

2. The photographic material of claim 1, wherein said silver halide grains contain an iridium compound in an amount of $10^{-8}$ mole or more per mole of silver halide.

3. The photographic material of claim 1, wherein said silver bromide-localized phase is formed by depositing at least one of silver bromide and silver bromochloride on said silver halide grains during chemical ripening.

* * * * *